US006812944B2

(12) United States Patent
Nakamura

(10) Patent No.: US 6,812,944 B2
(45) Date of Patent: Nov. 2, 2004

(54) THERMAL HEAD

(75) Inventor: Yuji Nakamura, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/367,129

(22) Filed: Feb. 14, 2003

(65) Prior Publication Data

US 2003/0179276 A1 Sep. 25, 2003

(30) Foreign Application Priority Data

Mar. 19, 2002 (JP) ..... 2002-075656

(51) Int. Cl.[7] ..... B41J 2/335
(52) U.S. Cl. ..... 347/208
(58) Field of Search ..... 347/208, 200, 347/201, 206, 207, 209; 29/611

(56) References Cited

U.S. PATENT DOCUMENTS 5,594,488 A * 1/1997 Tsushima et al. ..... 347/208
5,635,975 A * 6/1997 Shirakawa et al. ..... 347/208
5,680,170 A * 10/1997 Taniguchi et al. ..... 347/208
6,201,558 B1 * 3/2001 Shirakawa et al. ..... 347/208
6,501,497 B2 * 12/2002 Shirakawa et al. ..... 347/208

* cited by examiner

*Primary Examiner*—K. Feggins
(74) *Attorney, Agent, or Firm*—Adams & Wilks

(57) ABSTRACT

A thermal head has an insulating substrate, heat resistors formed over a surface of the insulating substrate, an individual electrode formed over the surface of the insulating substrate for supplying electric power to the heat resistors, and a common electrode connected to the individual electrode. A buildup electrode is disposed on the surface of the insulating substrate and is covered by the common electrode for reducing a wiring resistance of the common electrode. The buildup electrode has opposite main surfaces and a tapered side surface having a preselected taper angle relative to the surface of the insulating substrate.

19 Claims, 3 Drawing Sheets

THERMAL HEAD

BACKGROUND OF THE INVENTION

1. Field of the Invention

The present invention relates to a thermal head which is used for thermal recording such as facsimiles, printers and the like.

2. Description of the Related Art

As shown in FIG. 4, a conventional thermal head has been manufactured in a manner that a glaze layer is provided as a heat storage layer on an insulating substrate such as a ceramic substrate and the like, a heat resistor material such as a Ta system material, a silicide material, a Ni—Cr alloy and the like and an electrode material such as Al, Cr—Cu, Au, and the like are deposited by using a sputtering method, a vapor deposition method or the like, a heat resister, wiring electrodes of an individual electrode 1 and a common electrode 2 are formed by patterning through a photolithographic process, and then a protective film such as $SiO_2$, $Ta_2O_5$, SiAlON, $Si_3N_4$, SiC, and the like is deposited for preventing oxidation and wear of the heat resistor by using a sputtering method, an ion plating method, and a CVD method.

In recent years, a thermal printer having a thermal head has been used for small information terminal devices represented by small handy terminals which are small in size, light weight, and maintenance free.

For the small information terminal devices, electric power saving and high-speed printing are required because the small information terminal devices are driven by a battery. However, while at the present time a driving voltage of 5V is mainly used for the driving voltage of the thermal head, it is though that a driving voltage of 3V will be required in future. Further, reduction of the size of the thermal head and miniaturization of each wiring pattern have been proceeded with a decrease in the driving voltage. For this reason, the driving voltage of the thermal head is reduced, resistance is decreased by further miniaturization, and current consumption is increased, so that wiring resistance of a common electrode can not be neglected, even though the wiring resistance of the common electrode has been neglected. When the wiring resistance of the common electrode becomes higher, a so-called voltage drop occurs which causes a phenomenon of unevenness of printing density such that the printing density becomes low with a dot distant from a power supply in case of printing when voltage is applied to entire dots.

In order to solve these problems, it is necessary to enlarge a cross-sectional area (width×thickness) of the electrode, which causes the wiring resistance to be reduced. It is thought as one of methods for reducing the wiring resistance that the width of the electrode is enlarged. However, the enlargement of the width is limited because of limitations of space for wiring density in the individual electrode, and the width of the common electrode is also limited because of limitations of the size of the entire thermal head.

Another method for reducing the wiring resistance involves increasing the thickness of the electrode. However, increasing the thickness of the individual electrode in the heat resistor portion results in deterioration of the contact with the thermal recording paper and a decrease in printing efficiency. Production efficiency of forming electrode also becomes worse with an increase in the thickness of the electrode, thereby resulting in an increase in cost.

Generally, several methods for solving the above described problems have been known. First, a so-called wiring resistance correction in which the width and length of the heat resistor and the individual electrode are varied in each dot in order to adjust the resistance according to a distribution of the wiring resistance is known. Second, a so-called conductor printing reinforcement in which a conductive paste such as silver, gold, and the like is formed on an upper layer or a lower layer of the common electrode by printing and burning in order to reinforce the wiring resistance of the common electrode where current concentration is large is also known. Third, a method in which a buildup circuit such as FPC and the like is connected to the common electrode is also known.

However, in the wiring resistance correction for solving the unevenness of the printing density due to the voltage drop, there are drawbacks such that the entire printing density is reduced because adjustment is set to a higher value side of the wiring resistance even if the unevenness of the printing density can be eliminated, or on the contrary the unevenness of the printing density is enlarged because a correction rate is different depending on electric current consumption by a printing pattern or a printing ratio.

In the conductor printing reinforcement, there are drawbacks such that accuracy of printing position becomes a problem with progress in down-sizing and miniaturization, which can not sufficiently correspond to manufacturing of the thermal head, reliability is decreased by reduction of coverage of the protective film because the surface roughness is large due to the particle size of the conductive paste, and sometimes contact resistance between the common electrode of a thin film and the conductor buildup layer of a thick film is generated by burning condition of the conductive paste, which results sufficient effect of the conductor printing reinforcement not to be obtained.

In case that the buildup electrode is formed by using a thin film in order to solve the problems, though it is thought that the buildup electrode is formed by laminating a plurality of common electrodes, because a cross-sectional shape of a peripheral portion of the common electrode is almost a vertical shape by etching and the like, coverage of the common electrode of the upper layer is not good, which causes a problem such that a lack of electric continuity increases the contact resistance between the common electrode and the individual electrode in the step portion of the periphery of the common electrode.

SUMMARY OF THE INVENTION

In view of the foregoing, it is an object of the invention to obtain a thermal head which eliminates the unevenness of the printing density in case of printing with a low-voltage driving printer, secures the contact resistance between the common electrode and the individual electrode, and performs the higher efficiency of heating for printing in a manner that the pattern accuracy is improved corresponding to the further miniaturization and the wiring resistance is restrained in a low value when the common electrode is formed.

In order to solve the above-described problems, according to the invention, a thermal head includes at least a heat resistor, an individual electrode for supplying electric power to the heat resistor, a common electrode connected to the individual electrode, and a protective film covering the heat resistor and the individual electrode of the periphery of the heater resistor on an insulating substrate, a peripheral portion of the buildup electrode has a tapered shape and a buildup electrode is formed to be covered by the common electrode.

In the thermal head having the above-described structure, since the common electrode is formed to cover the buildup electrode and the peripheral portion of the buildup electrode of a lower layer has the tapered shape, and the wiring resistance is restrained in a low value and electric continuity is secured in a step portion of the periphery of the common electrode, so that contact resistance between the common electrode and the individual electrode can be secured. As a result, the unevenness of the printing density is eliminated because the influence of the voltage drop is eliminated in case of printing by the low-voltage driving printer, and the higher efficiency of heating for printing can be performed, so that printing quality is improved.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Figure 1:
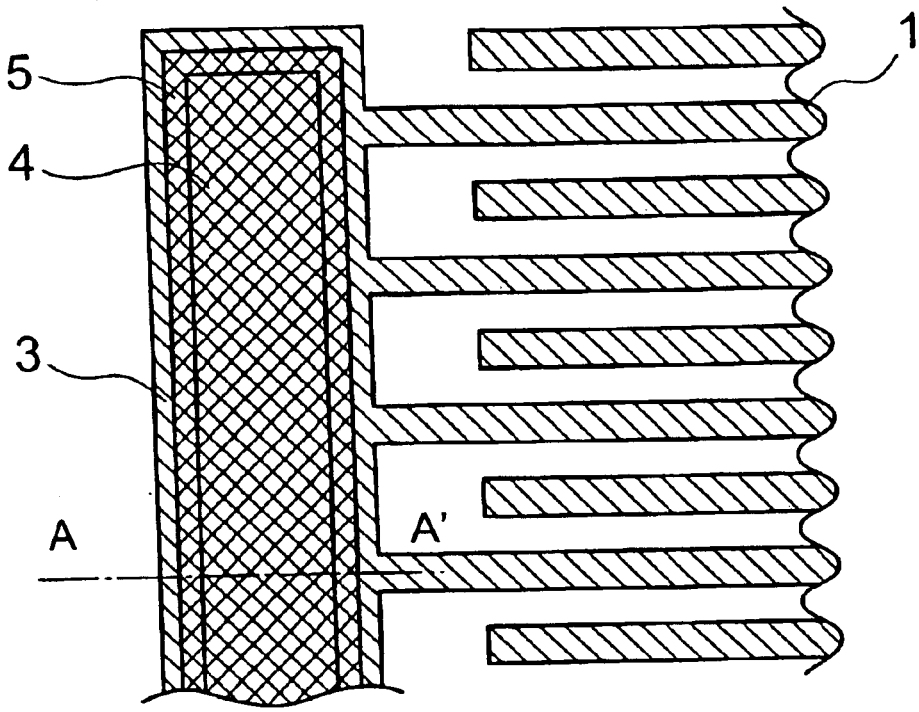
FIG. 1 is an extended plan view of a common electrode and an individual electrode of a thermal head according to the invention.
Figure 2:
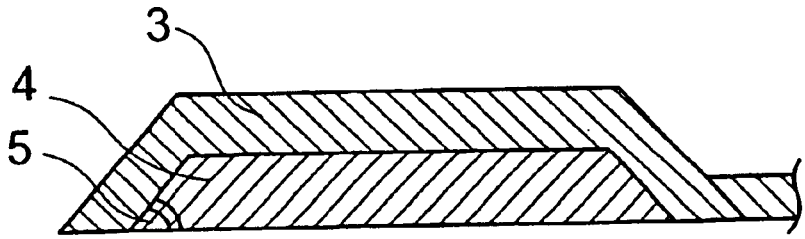
FIG. 2 is a cross-sectional view of a common electrode and an individual electrode of a thermal head according to the invention.

A preferred embodiment of the invention will be described below referring to figures. FIG. 1 is an extended plan view showing a common electrode 3 and an individual electrode 1 of a thermal head of the invention. FIG. 2 is a cross-sectional view taken on line A–A' of FIG. 1.

In FIG. 1, a glaze layer is formed on a surface of an insulating and a buildup electrode 4 is formed on the glaze layer. The buildup electrode 4 has opposite main surfaces and a side surface or peripheral portion 5. The peripheral portion 5 of the buildup electrode 4 is a tapered. The common electrode 3 and the individual electrode 1 are formed to connect electrically to a heat resister and to cover the entire buildup electrode 4. As shown in FIG. 2, when the common electrode 3 is formed, because the peripheral portion 5 of the buildup electrode 4 has a tapered shape, there is no step portion of a vertical shape in the peripheral portion of the buildup electrode 4 to reduce the wiring resistance of the entire common electrode 3, which provides the thermal head of the invention with a construction so that the electric continuity between the common electrode 3 and the individual electrode 1 is held and the contact resistance is secured.

A manufacturing process of the invention will be described referring to FIG. 1. The glaze layer made of $SiO_2$ for heat storage is formed on the insulating substrate made of a material such as, for example, alumina ceramics and the like.

By using a material which mainly contains Al, such as an Al material, Al—Si, Al—Si—Cu, and the like, the buildup electrode 4 is formed in the thickness range from about 1.2 to about 3.6 $\mu$m by the sputtering method and the like, photoresist is applied to expose and develop by using a photomask, and a resist pattern having a buildup electrode shape is formed.

A tapered etching technique disclosed in Japanese Patent Laid-Open No. 127143/1998 is applied in which an etching solution whose viscosity is adjusted by a mixing rate of a mixed acid water solution consisting of phosphoric acid, acetic acid, nitric acid, pure water, and the like. When an Al film is etched by using the etching solution having low viscosity, the etching solution also penetrates into an interface between the photoresist and the Al film to proceed in a surface direction of the Al film while Al etching. By adjusting properly the relationship between an etching rate of the surface direction and that of a film thickness direction, it is possible to form the tapered portion in the peripheral portion of the electrode after etching.

At this point, it is possible to select freely a tape angle of the peripheral portion 5 of the buildup electrode 4 by controlling a forming condition of the photoresist pattern or a temperature of the etching solution. Then, the photoresist is removed by a stripping solution such as an organic solvent and the like to form the buildup electrode 4 and the tapered portion 5 of the buildup electrode.

Figure 3:
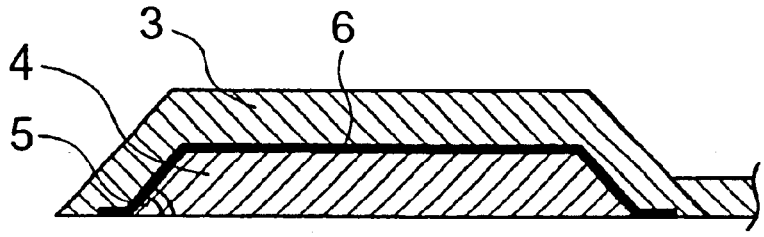
FIG. 3 is a cross-sectional view of common electrode and an individual electrode of a thermal head according to the invention.
Figure 4:
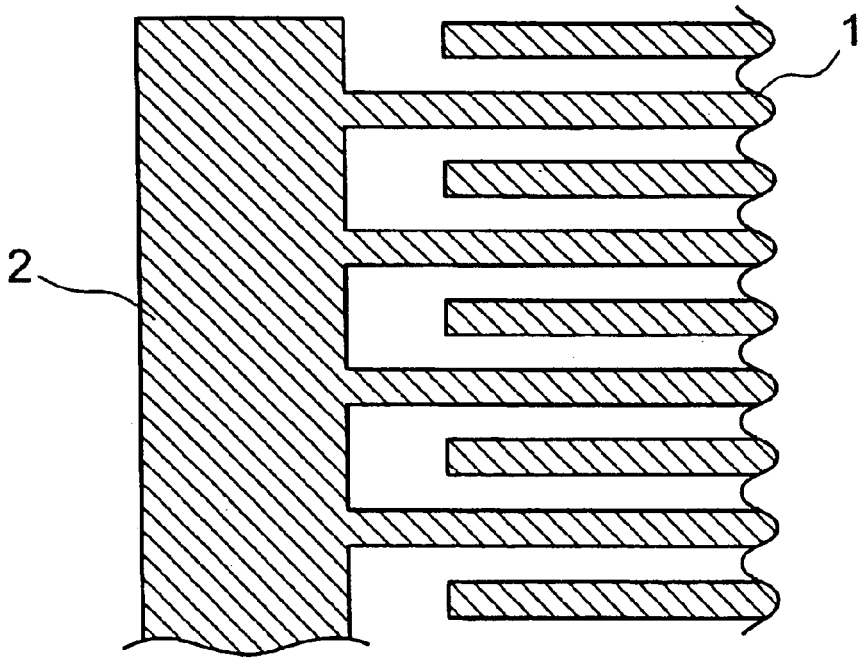
FIG. 4 PRIOR ART
FIG. 4 is an extended plan view of a buildup electrode, a common electrode, and an individual electrode of a conventional thermal head.

After a Ta—N or Ta—$SiO_2$ film or the like, which contains mainly Ta, is formed about 0.1 $\mu$m thickness as a material of the heat resistor by the sputtering, the heat resistor is formed by the photolithography. At this point, as shown in FIG. 3, a pattern may be formed such that the buildup electrode 4 is entirely covered by a heat resistor 6. In case that the buildup electrode 4 is exposed during the etching of the heat resistor, a surface of the buildup electrode and the shape of the tapered portion 5 become rough by suffering from damage of the etching solution for the heat resistor, however, the roughness can be reduced by entirely covering the buildup electrode 4 with the heat resistor 6, so that the reliability of the wiring resistance or the thermal head can be held.

An Al, Al—Si or Al—Si—Cu film or the like, which contains mainly Al, is formed by the sputtering in the thickness range from about 0.6 $\mu$m to about 2 $\mu$m as an electrode material of the individual electrode 1 and the common electrode 3 for supplying the electric power to the heat resistor. At this point, by using intentionally the same material as the buildup electrode 4, not only adhesiveness and affinity between layers of the common electrode 3 and the buildup electrode are increased, but also problems such as inter layer peeling caused by thermal stress and the like can be eliminated.

The pattern formation of the common electrode 3 and the individual electrode 1 are performed by the photolithography so as to cover the entire buildup electrode 4. At this point, by using the etching solution which is used in the formation of the buildup electrode 4, the peripheral portion of the electrode of the individual electrode 1 and the common electrode 3 may be formed in a tapered shape. At the time the electric continuity from the common electrode 3 to the individual electrode 1 is sufficiently held and the contact resistance is secured, because the tapered portion is formed on the peripheral portion of the buildup electrode 4.

It is understood from experimental results that in case that the taper angle is not larger than 45° as the shape of the tapered portion 5, the electric continuity from the common electrode 3 to the individual electrode 1 is sufficiently held and the contact resistance is secured without influence of the step portion of the buildup electrode 4, even in the worst condition in which the buildup electrode of the lower layer is as thick as possible and the common electrode of the upper layer is as thin as possible.

Furthermore, in order to protect from the oxidation and improve the wear resistance of the heat resister and the individual electrode 1, the protective film layer made of a mixed film such as $Si_3N_4$, $SiO_2$, and the like is formed in the thickness range from about 3 to about 6 $\mu$m by the sputtering and the like so as to cover the peripheral portions of the heat resistor and the individual electrode 1, at the same time heating treatment more than 20° C. is performed in order to improve the adhesiveness and denseness of the film.

In the thermal head obtained by the above-described processes, the wiring resistance of the whole common electrode 3 is formed to be extremely low.

Figure 5:
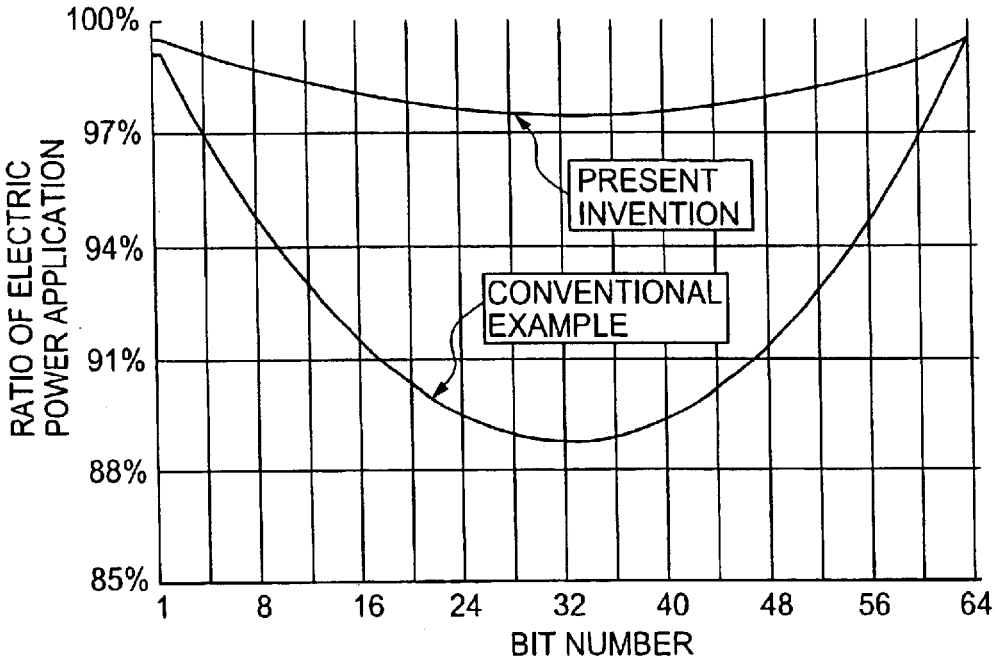
FIG. 5 is an illustration showing a ratio of electric power application of a thermal head according to the invention.

Evaluation results of the embodiment of the invention will be described below. FIG. 5 is an illustration showing a ratio of electric power application of a thermal head according to the invention. A horizontal axis is the number of bits in a driver IC and GND is connected to 1ch or 64ch. Compared with a conventional example in which the ratio of electric power application is electric power loss of about 11% in a central portion, in the present invention the ratio of electric power application is stayed in the electric power loss of only about 2% in a central portion, so that the voltage drop of the common electrode 3 is restrained in an extremely low value in the invention, consequently it is confirmed that the ratio of electric power application is improved by about 10%.

Figure 6:
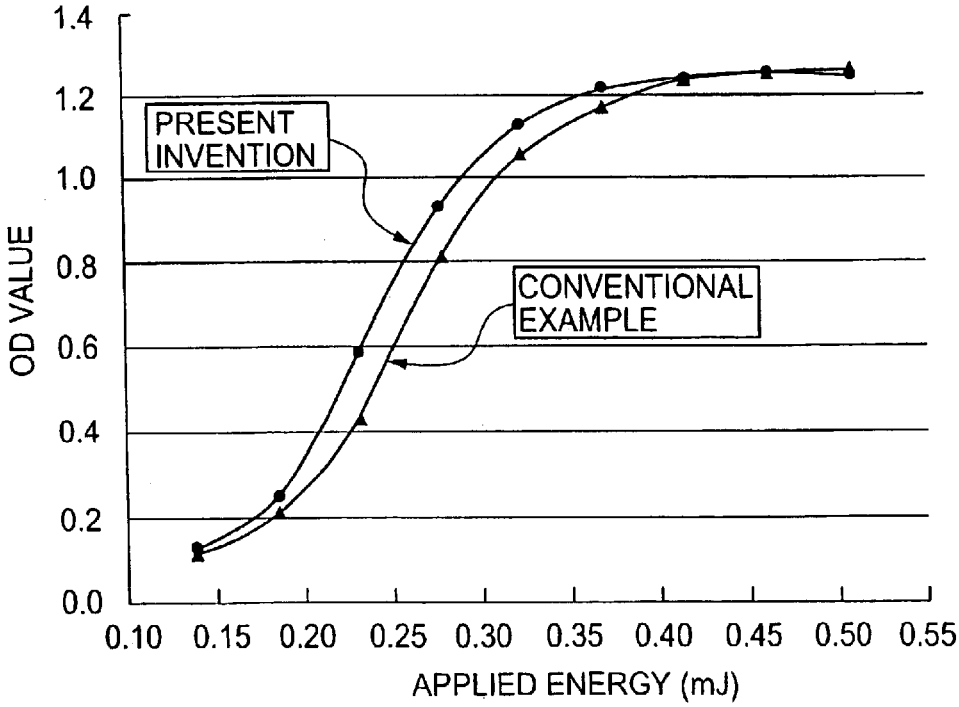
FIG. 6 is an illustration showing a print density curve of a thermal head according to the invention.

FIG. 6 is an illustration showing a print density curve of a thermal head according to the invention. Compared with a conventional example, it is confirmed in the invention that the printing efficiency is improved by about 10%. As described in FIG. 5, since it is confirmed in the invention that the ratio of electric power application is improved by about 10%, the result of the printing efficiency supports the result of the ratio of electric power application. Accordingly, it is confirmed in the invention that not only the voltage drop of the central portion is restrained in an extremely low value, but also the printing efficiency is improved by about 10%.

In the invention, the peripheral portion of the buildup electrode 4 has the tapered shape, and the entire buildup electrode 4 is covered by the common electrode 3, so that the wiring resistance of the common electrode 3 is restrained in a low value and contact resistance between the common electrode 3 and the individual electrode 1 can be secured.

As a result, the unevenness of the printing density is eliminated because the influence of the voltage drop is eliminated in case of printing by the low-voltage driving printer, and the higher efficiency of heating for printing can be performed, so that printing quality is improved and printing speed can be higher. Since the efficiency of heating for printing can be improved, it is possible that the further low-voltage driving is realized, low-electric power consumption is achieved, and driving life is lengthened. In case that the low-electric power consumption is achieved, generation of noise in printing is restrained, which allows noise from the printer to be restrained.

The electric power to the heat resistor of the thermal head is restrained to a low value by improving the printing efficiency, thereby allowing durability of the thermal head to be improved. Furthermore, the thermal head of the invention has good productivity and the advantage that manufacturing cost can be restrained without complicating the manufacturing process because the introduction of new facilities is not necessary.

What is claimed is:

1. A thermal head comprising: an insulating substrate; a plurality of heat resistors formed over a surface of the insulating substrate; an individual electrode formed over the surface of the insulating substrate for supplying electric power to the heat resistors; a common electrode connected to the individual electrode; and a buildup electrode disposed on the surface of the insulating substrate and covered by the common electrode for reducing a wiring resistance of the common electrode, the buildup electrode having opposite main surfaces and a tapered side surface disposed at a preselected taper angle relative to the surface of the insulating substrate.

2. A thermal head according to claim 1; wherein the preselected taper angle of the tapered side surface of the buildup electrode is not larger than 45°.

3. A thermal head according to claim 1; wherein the buildup electrode is entirely covered by the common electrode.

4. A thermal head according to claim 1; wherein the heating resistors are disposed over the buildup electrode so as to entirely cover the buildup electrode.

5. A thermal head according to claim 1; wherein the individual electrode, the common electrode and the buildup electrode are made of the same material.

6. A thermal head according to claim 5; wherein the material for the individual electrode, the common electrode and the buildup electrode is selected from the group consisting of Al, Al—Si, and Al—Si—Cu.

7. A thermal head comprising: an insulating substrate; a plurality of heat resistors formed over a surface of the insulating substrate; an individual electrode formed over the surface of the insulating substrate for supplying electric power to the heat resistors; a common electrode connected to the individual electrode; a buildup electrode disposed on the surface of the insulating substrate and under the common electrode for reducing a wiring resistance of the common electrode; and an intermediate layer disposed between the buildup electrode and the common electrode during formation of the heat resistors.

8. A thermal head according to claim 7; wherein the buildup electrode has opposite main surfaces and a tapered side surface disposed at a preselected taper angle relative to the surface of the insulating substrate.

9. A thermal head according to claim 8; wherein the preselected taper angle of the tapered side surface of the buildup electrode is not larger than 45°.

10. A thermal head comprising:

a substrate;

a heat insulating layer formed on the substrate;

a buildup electrode formed on a surface of the heat insulating layer, the buildup electrode having first and second opposite main surfaces and a tapered side surface having a preselected taper angle relative to the surface of the heat insulating layer;

a heat resistor formed on the buildup electrode;

an individual electrode disposed over the surface of the heat insulating layer for supplying electric power to the heat resistor; and a common electrode connected to the individual electrode and disposed over the first main surface and the tapered side surface of the buildup electrode so that a wiring resistance of the common electrode is reduced by the buildup electrode.

11. A thermal head according to claim 10; wherein the individual electrode, the common electrode and the buildup electrode are made of the same material.

12. A thermal head according to claim 11; wherein the material for the individual electrode, the common electrode and the buildup electrode is selected from the group consisting of Al, Al—Si, and Al—Si—Cu.

13. A thermal head according to claim 10; wherein the preselected taper angle of the tapered side surface of the buildup electrode is not larger than 45°.

14. A thermal head according to claim 13; wherein the second main surface of the buildup electrode is not tapered.

15. A thermal head according to claim 10; wherein the heat resistor is formed on the entire first main surface and the entire side surface of the buildup electrode.

16. A thermal head according to claim 10; further comprising a protective film layer disposed over the individual electrode and a peripheral portion of the heat resistor for preventing oxidation of and reducing wear of the individual electrode and the heat resistor.

17. A thermal head according to claim 10; wherein the heat insulating layer comprises a layer of $SiO_2$.

18. A thermal head according to claim 10; wherein the buildup electrode has a thickness in the range of from about 1.2 $\mu$m to about 3.6 $\mu$m.

19. A thermal head according to claim 10; wherein the second main surface of the buildup electrode is not tapered.

* * * * *